United States Patent [19]

Verma

[11] 4,448,052

[45] May 15, 1984

[54] HYDROSTATIC ASSIST DURING ROLLING OF CAST METAL

[75] Inventor: Deepak K. Verma, Rochester, Minn.

[73] Assignee: Southwire Company, Carrollton, Ga.

[21] Appl. No.: 345,843

[22] Filed: Feb. 4, 1982

[51] Int. Cl.[3] ..... B21D 39/08

[52] U.S. Cl. ..... 72/57; 72/206

[58] Field of Search ..... 72/57, 60, 199, 206, 72/250, 262, 54, 62, 45; 164/417

[56] References Cited

U.S. PATENT DOCUMENTS 3,553,996 1/1971 Sabroff et al. ..... 72/60

4,043,166 8/1977 Leroy ..... 72/45

4,129,170 12/1978 Cofer et al. ..... 164/417

*Primary Examiner*—Daniel C. Crane

*Assistant Examiner*—David B. Jones

*Attorney, Agent, or Firm*—Herbert M. Hanegan; Robert S. Linne; Michael C. Smith

[57] ABSTRACT

Apparatus for and a method of hot rolling cast metal under hydrostatic pressure to achieve a substantial reduction in cross-sectional area without cracking and the improved wrought product thereof characterized by decreased segregation, better grain structure and absence of cracking.

7 Claims, 2 Drawing Figures

HYDROSTATIC ASSIST DURING ROLLING OF CAST METAL

TECHNICAL FIELD

The present invention relates generally to metal rolling, and specifically to an apparatus and a method for continuously rolling a metal under hydrostatic pressure to achieve a substantial reduction in area without cracking.

BACKGROUND ART

It is well known that many metals, such as copper, may be continuously cast in a rotating casting wheel to obtain a cast bar which is then immediately hot-formed in a substantially as cast condition by passing the cast bar exiting the casting wheel to and through the roll stands of a continuous rolling mill while the cast bar is still at a hot-forming temperature. It is also well known that the as cast structure of the metal bar is such that cracking of the cast bar during hot-forming may be a problem to be overcome if the cast bar is to be directly hot-formed into a small product, such as coiled rod, which requires that the desired cross-sectional area of the cast bar be substantially reduced by a plurality of deformations along different axes to provide the cross-sectional area of the product.

While this problem could be avoided by casting a cast bar having a small cross-sectional area which need not be substantially reduced to provide the cross-sectional area of the product, this solution to the cracking problem described above is not practical since high casting rates, in terms of volume of product, can be readily achieved only with cast bars having large cross-sectional areas which are reduced to the small cross-sectional areas of products, such as 3/8 inch diameter rod for drawing into wire, by a plurality of deformations along different axes. Alternately the problem may be avoided by providing a large number of roll stands which each reduce the area of the cast bar by only a small amount. However the great expense of continuous rolling mills requires that the number of roll stands be minimized. Thus, the problem of a cast metal cracking during hot-forming which is described above must be solved within the context of cast bars having large cross-sectional areas which are hot-formed into products having small cross-sectional area and the use of heavy reductions which may be substantial enough to cause cracking of the cast bar if the problem is not overcome in some manner.

This problem has been overcome in the prior art for relatively pure electrolytically refined copper having impurity levels such as 3 to 10 ppm lead, 1 ppm bismuth and 1 ppm antimony. For example, U.S. Pat. No. 3,317,994, and U.S. Pat. No. 3,672,430 disclose that this problem can be overcome by conditioning such relatively pure copper exiting from a casting wheel as a cast bar by initial reductions of the cross-sectional area in the initial roll stands sufficient to substantially completely destroy the as-cast structure of the cast bar. The additional reductions along different axes of deformation which would cause cracking of the cast bar but for the destruction of the as-cast structure of the cast bar may then safely be performed. This conditioning of the cast bar not only prevents cracking of the cast bar during hot-forming but also has the advantage of accomplishing a large reduction in the cross sectional area of the cast bar while its hot-forming temperature is such as to minimize the power required for the reduction. However, the prior art has not provided a solution to the cracking problem described above for metals, such as recycled copper, containing a relatively high degree of impurities, because the large amount of impurities collect in the grain boundaries of the as-cast structure and cause the cast bar to crack when an attempt is made to substantially destroy the as cast structure with a large initial reduction of the cross sectional area (e.g. 36%) which is effective with lower impurity metals. Moreover, the greater the percentage of impurities in the cast bar, the more likely it is that cracks will occur during hot forming.

Thus, although there is no need as a practical matter to use electrolytically refined copper, except for specialized uses such as magnet wire, it has been necessary to use such highly refined copper for all wire rod in order to be able to obtain the many advantages of tandem continuous casting and hot forming apparatus. As a result, a substantial refining cost is added to the price of many final copper products even though high purity is not required to meet conductivity or other specifications. For example, fire-refined copper wire having a high degree of impurities can meet the IACS conductivity standard for household electrical wiring and can be produced more economically if the rod to be drawn into such wire can be produced using continuous casting and hot forming apparatus.

U.S. Pat. No. 3,317,994, U.S. Pat. No. 4,129,170 and U.S. Pat. No. 3,349,471 illustrate the state of the art in continuously casting molten metal into bar and immediately rolling it into rod. In such systems hot bar is passed through a series of reduction roll stands and emerges as a rod which is collected for further processing. Depending on the quality and type of metal being cast, substantial initial reduction is often advantageous in controlling grain structure, segregation, invese segregation, uniformity of inclusion dispersal, and productivity. Until the present invention, initial reduction has been limited because when using greater degrees of initial reduction, metal bar of a lower purity level will often crack. Thus this cracking problem occurs most often in lower grades of metal, even at relatively low reductions, as well as in higher grades of metal at the higher reductions.

Less well known in the art is the effect of hydrostatic pressure on these same metals. However, it has been an observed fact for quite some time that highly brittle materials such as sandstone and marble show appreciable ductibility when subjected to very high hydrostatic pressure. The level of ductility evidently increases with increasing pressure. An article by P. W. Bridgman appearing in *Reviews Of Modern Physics,* Volume 17, Number 1, January, 1945 entitled "Effects of High Hydrostatic Pressure on the Plastic Properties of Metals" discusses effects at various high pressures such as 34,000 p.s.i. to 387,000 p.s.i. The related subject of hydrostatic extrusion is addressed by U.S. Pat. No. 2,558,035 wherein material is cold drawn through a die while under influence of 400,000 p.s.i. hydrostatic pressure. Until the present invention, however, the problem of cast metal cracking during continous hot rolling has not been satisfactory dealt with nor have the effects of lower hydrostatic pressure been investigated in this regard.

DISCLOSURE OF THE INVENTION

A cast product is relatively anisotropic and brittle relative to a wrought product because of inherent cast grain structure and residual stresses developed during the casting process. The effect becomes more pronounced and severe with increasing levels of impurities and second phase particles which both tend to collect at the grain boundaries. The reduced level of ductility available in such a cast product tends to be a problem when trying to roll such a product either continously or in a batch manner. Heavy reductions in the rolling mill have been found to be limited because of cracks appearing in the product just ahead of the first roll stand. The usual result is failure to get a sound rolled product economically.

According to this invention a cast product which has limited ductility and which cracks ahead of the rolls when subjected to a heavy reduction, is made to pass through a conditioning chamber maintained at an appropriate high pressure with an appropriate fluid. Suitable fluids for use when the metal is copper include a soluble oil mixture or water and 3% alcohol, both tend to remove any oxide layer just ahead of the first roll stand. Alternately, the rolls and a short length (12 inches) of the stock before and after the rolls are enclosed in a high pressure chamber maintained at an appropriate pressure by an appropriate fluid (like soluble oil or water and alcohol). This conditioning pressure then locally increases the fracture stress (tensile in nature) and thus eliminates cracking of the cast product ahead of the rolls and permits heavy reductions without the usual cracking.

The fluid under pressure is preferably forced into the chamber by venturi action from one or both sides of the rolls as shown in the drawings and withdrawn from a suitable point for recirculation thereby eliminating the need for complete sealing between the moving stock and the chamber. The shafts supporting the rolls are sealed from the chamber by high pressure "viton" seals well known in the art. The hydrostatic pressure will, therefore, increase the fracture stress because the nucleation and/or growth of the cracks will be suppressed. One clear advantage to this process is successful rolling of high impurity copper (i.e. Anode grade) obviating the need for expensive electrochemical purification.

This invention eliminates the problem of cracking and results in a better grain structure after rolling along with the advantage of decreased segregation. For a five square inch bar cast from #1 to selected #2 scrap, a pressure between 5,000 to 10,000 psi is used. The level of the pressure depends somewhat upon the level of ductility available in the cast bar and the reduction desired during rolling.

The present invention solves the cracking problem associated with prior art continuous casting and rolling of metal by providing apparatus for and a method of hot rolling metal under hydrostatic pressure to achieve substantial reduction without cracking, and provides an improved product thereof chracterized by decreased segregation, better grain structure and absence of cracking.

Thus a major object of this invention is to provide apparatus for and a method of hot rolling metal under hydrostatic pressure to achieve substantial reduction without cracking.

Another object of the present invention is to provide apparatus for and a method of hot rolling high impurity metal under hydrostatic pressure to achieve substantial reduction without cracking.

Still another object of this invention is to provide improved metal products characterized by decreased segregation, better grain structure and absence of cracking.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
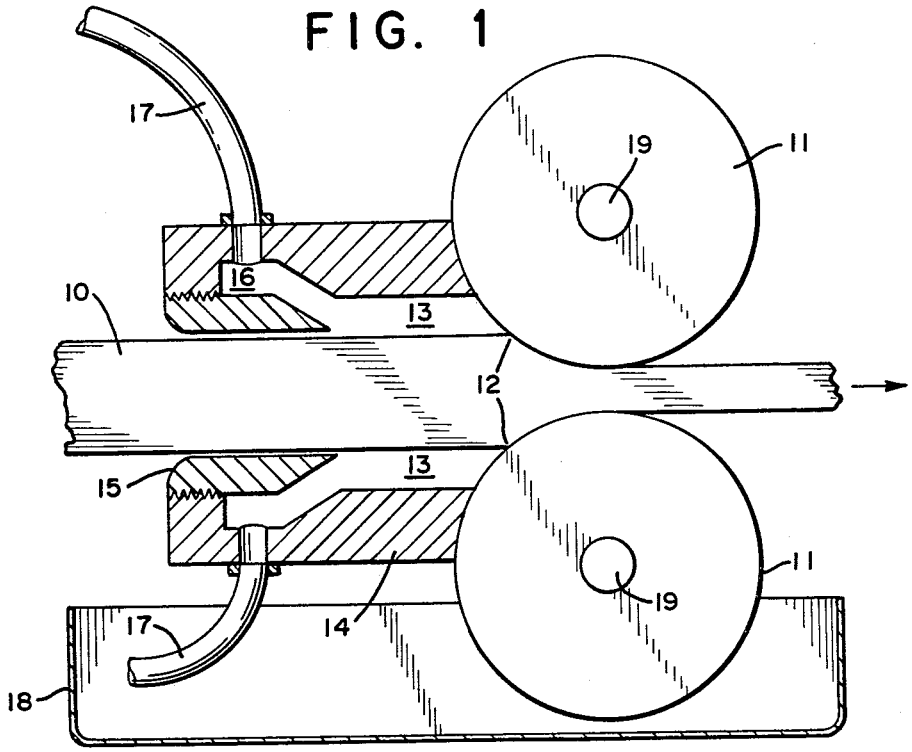
FIG. 1 is a cross sectional view of portions of a roll stand adapted with a first embodiment of the present invention.

As FIG. 1 illustrates, cast bar 10 passes between rolls 11 of a roll stand which deform and reduce the size of the bar 10 by compression. Although rolling is generally considered a compressive process, tensile forces are also exerted on the bar 10 by the rolls 11, and in prior art rolling systems such forces often result in cracks on the surface of the bar generally perpendicular to the longitudinal axis of the bar. Cracks occur immediately before the bar/roll contact areas 12 because the outer surface of the bar 10 is pulled inward by immediately preceeding portions of the bar 10 which are being compressed by the rolls 11. This transition from ambient pressure to sudden severe deformation pressure on the surface of the cast bar 10 is eliminated by the present invention which applies hydrostatic pressure to the surface of the cast bar 10 in the area having propensity to crack so as to offset the tensile forces which otherwise cause cracking.

A hydrostatic pressure chamber 13 is created in the area immediately in front of the rolls 11 by a housing 14 having a central passageway of a diameter somewhat larger (e.g. 10%) than the cross sectional area of the cast bar 10. The housing 14 cooperates in near sealing relationship with the rolls 11 and other surfaces downstream of the bar/roll contact areas 12. Attached to the housing 14 is a bar entrance sealing member 15 which cooperates in near sealing relationship with the outer surfaces of the cast bar 10 prior to the bar/roll contact area 12. Member 15 is preferably also adapted with a tapering entrance to serve as a guide for the cast bar 10 during initial start up. Shafts 19 supporting rolls 11 are sealed from the chamber 13 by well known high pressure seals (not shown). An annular hydrostatic liquid passageway 16 is formed by housing 14 and member 15 in such a manner that a venturi in the direction of the bar/roll contact area 12 is created. One or more high pressure liquid supply lines 17 are connected to the passageway 16 for introduction of the liquid into the hydrostatic pressure chamber 13. A liquid such as a soluble oil or a water and alcohol mixture is flowed under high pressure, preferably from about 5,000 psi to about 10,000 psi into the pressure chamber 13 and offsets some of the tensile force working on the bar surface at area 12 to eliminate cracking.

The liquid continuously escapes from the pressure chamber 13 by leaking out through the small space between the sealing member 15 and the bar 10 and between the housing 14 and the rolls 11. Liquid also adheres to the bar 10 as it exits the chamber 13 to lubricate the bar 10, the rolls 11 and other members downstream. A drain pan 18 is perferably provided to receive leaking liquid for recirculation thereof. As may be expected, liquid leakage can become a serious problem if a large flow rate prevents achieving proper pressure within the chamber 13. Therefore, having disclosed the primary inventive concept in the simple embodiment of FIG. 1, a second and more complex embodiment is shown by FIG. 2.

Figure 2:
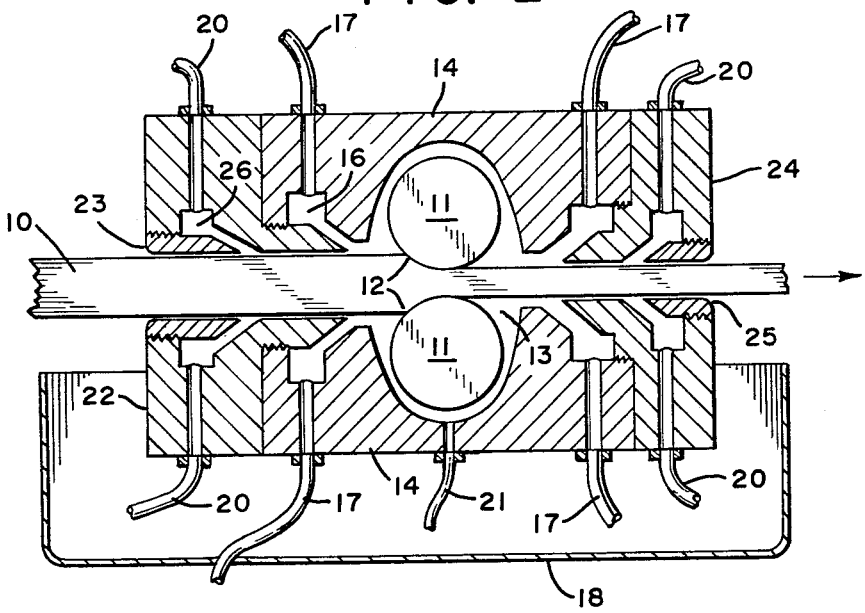
FIG. 2 is a cross sectional view of portions of a roll stand adapted with a second embodiment of the present invention.

The major features of the FIG. 2 embodiment differing from the FIG. 1 embodiment include expansion of the pressure chamber 13 to cover an area of the bar immediately beyond the rolls 11, supplementation of the high pressure system supplied by high pressure liquid supply lines 17 by a medium pressure system supplied by medium pressure supply lines 20, and the addition of drain means 21. By expanding the pressure chamber 13 to include the post rolling area, leakage from the downstream end of the chamber 13 can be controlled in a manner similar to that of controlling leakage at the entrance end of the chamber 13. The FIG. 2 embodiment forms the chamber 13 by interconnection of a housing 14, a sealing entrance member 22 adapted to cooperate in near sealing relationship with the advancing cast bar 10, and a sealing exit member 24 adapted to cooperate in near sealing relationship with the exiting rolled product formed from the bar 10. Passageways 16 are formed in the housing 14 similar to those of the FIG. 1 embodiment and are adapted to create high pressure venturi action in the direction of the bar/roll contact area 12 from both upstream and downstream of the rolls. Additionally, exit member 25 and entrance member 23 are attached to members 24 and 22 respectively in near sealing cooperation with the exiting and entering product 10 respectively. Passageways 26 similar to 16 as above described, are provided in members 24 and 22 with similar venturi features except that instead of being adapted for high pressure of from about 5,000 psi to 10,000 psi, medium pressure of from about 1,000 psi to about 5,000 psi is used to discourage leakage from the high pressure chamber 13 through either member 24 or member 22. Member 23 is adapted for bar guidance similar to member 15 of FIG. 1. Also as in FIG. 1 reservoir 18 is provided to collect leakage for recirculation. Drain means 21 are also provided to promote recirculation.

Thus an efficient and effective system for substantially eliminating the tensile cracking often associated with metal rolling has been described.

While this invention has been described in detail with particular reference to preferred embodiments thereof, it will be understood that variations and modifications can be effective within the spirit and scope of the invention as described hereinbefore and as defined by the appended claims.

What is claimed is:

1. A method of continuously rolling a cast metal bar while preventing serious cracking of the bar surface due to tension exerted upon the unrolled surface by the adjacent rolled surface, comprising applying a fluid under pressure to the bar and creating a hydrostatic compressive stress on the unrolled bar surface immediately prior to rolling; said stress sufficient to reduce rolling tension to below the level needed to crack the bar; and said step of applying a hydrostatic compressive stress to the bar surface includes the steps of flowing a liquid under a first high pressure to and around the bar immediately prior to rolling while flowing a liquid under a second, lower, pressure to and around the bar immediately prior to contacting said bar with said first high pressure so that the flow of the second lower pressure liquid assists in sealing the first high pressure liquid around the bar.

2. The method of claim 1 wherein said metal is anode grade copper and said stress is provided by subjecting the cast bar to a hydrostatic pressure of more than about 5000 psi.

3. The method of claim 2 wherein said copper is sequentially rolled through a series of roll stands and said hydrostatic pressure is applied to the cast bar in at least the first of said series of roll stands.

4. The method of claim 3 further including the step of reducing the cross-sectional area of the cast bar by more than about 36 percent in said first roll stand.

5. The method of claim 1 further including the step of flowing liquid under a first high pressure to a chamber enclosing the rolls and a length of bar passing therebetween so that a hydrostatic compressive stress is maintained on the surface of the bar before, during, and after rolling.

6. Apparatus for continously rolling a cast bar comprising in combination:

at least two rolls for deforming a cast bar passed therebetween;

a hydrostatic pressure chamber immediately preceeding said rolls and adapted to surround a portion of the moving cast bar; and wherein said pressure chamber further comprises;

having an interior passageway somewhat larger than the cast bar to be rolled; and means for flowing a fluid under pressure into said chamber to exert a compressive force on the surface of a moving cast bar prior to rolling by said rolls; said chamber having at least one sealing member attached thereto, said member in communication with the fluid flowing means and forming an entrance to said passageway for the cast bar but also providing resistance to the flow of fluid from the passageway.

7. Apparatus for continuously rolling a cast bar comprising in combination:

at least two rolls for deforming a cast bar passed therebetween;

a hydrostatic pressure chamber adapted to surround a portion of the moving cast bar; and means for flowing a fluid under pressure into said chamber to exert a compressive force on the surface of a moving cast bar prior to rolling by said rolls;

wherein said pressure chamber further comprises;

a housing enclosing said rolls and a portion of a cast bar passed therebetween, said housing having an entrance end, a middle chamber, and an exit end; and at least one sealing member attached to each of said entrance end and exit end of the housing, said sealing members communicating with the fluid flowing means and containing an annular fluid passageway for directing fluid into said middle chamber.

* * * * *